United States Patent [19]

Elkin et al.

[11] Patent Number: 4,776,408

[45] Date of Patent: Oct. 11, 1988

[54] PNEUMATIC IMPACT TOOL

[75] Inventors: Robert D. Elkin, La Verne; Ahmed El Dessouky, Paramount, both of Calif.

[73] Assignee: Deutsch Fastener Corporation, Los Angeles, Calif.

[21] Appl. No.: 26,734

[22] Filed: Mar. 17, 1987

[51] Int. Cl.[4] ..... B25D 17/00

[52] U.S. Cl. ..... 173/139; 173/162.1; 92/85 A; 92/85 B

[58] Field of Search ..... 173/139, 162.1, 162.2; 92/85 R, 85 B, 85 A, 143

[56] References Cited

U.S. PATENT DOCUMENTS

| | | | |
|---|---|---|---|
| 2,888,679 | 6/1959 | Peterssen et al. | 173/139 |
| 2,899,934 | 8/1959 | Salengro | 173/139 X |
| 3,727,700 | 4/1973 | Amtsberg | 173/139 X |
| 3,788,404 | 1/1974 | Koudelka et al. | 173/139 |
| 3,920,086 | 11/1975 | Goppen et al. | 173/162 |
| 4,237,987 | 12/1980 | Sherman | 173/139 X |
| 4,308,926 | 1/1982 | Montabert | 173/162 R |
| 4,388,972 | 6/1983 | Gidlund | 173/162 R |

*Primary Examiner*—E. R. Kazenske
*Assistant Examiner*—James L. Wolfe
*Attorney, Agent, or Firm*—Pretty, Schroeder, Brueggemann & Clark

[57] ABSTRACT

A pneumatic impact tool having a special cushioning assembly for cushioning the repeated recoil of a hammer piston and thereby providing substantially reduced tool vibration during use. The cushioning assembly includes an energy-dissipating damping sub-assembly and an energy-storing coil spring sub-assembly arranged in series with each other such that they operate simultaneously, yet independently, to cushion the hammer piston's rearward movement over a wide range of operating speeds.

11 Claims, 2 Drawing Sheets

PNEUMATIC IMPACT TOOL

BACKGROUND OF THE INVENTION

This invention relates generally to pneumatic impact tools such as rivet guns, and, more particularly, to pneumatic impact tools having means for cushioning the successive recoils of the tool's reciprocating hammer piston.

Pneumatic impact tools of this general kind usually include a barrel and a pistol handle, with a hammer piston reciprocating under the force of pressurized air within a working cylinder in the barrel. Forward movement of the hammer piston is stopped by its impact upon a tool attachment that is useful, for example, in installing a rivet. Rearward movement of the hammer piston, on the other hand, is usually stopped by its impact upon a rigid wall at the barrel's rearward end. The resulting periodic rapid decelerations of the hammer piston produce vibrations that are transmitted directly to the user's hand and arm, causing him considerable discomfort. If the impact tool is used over an extended period, this vibration can even cause physical damage.

Several attempts have been made in the past to cushion the periodic recoil of the hammer piston and thereby reduce its harmful physical effects. Some prior tools have, therefore, included coil springs and/or pneumatic air cushions to stop the hammer piston's rearward movement. Although these prior devices have proven generally effective in reducing the magnitude of tool vibration, they are believed to be unduly complicated and subject to frequent breakdowns.

There is a need for a pneumatic impact tool that reliably provides even greater cushioning of the tool's recoiling hammer piston, so as to reduce tool vibration and improve the user's comfort. The present invention fulfills this need.

SUMMARY OF THE INVENTION

The present invention is embodied in a pneumatic impact tool having special cushioning means for substantially reducing vibrations that occur during the tool's recoil. The impact tool includes a tool housing containing a hollow cylinder, with a hammer piston reciprocably movable within the cylinder. The hammer piston reciprocates between a forward position, where it impacts upon a tool attachment such as a rivet set, and a rearward position, where it impacts upon the cushioning means. In accordance with the invention, the cushioning means includes energy-storing spring means and energy-dissipating damping means, which are arranged in series with each other to resist rearward movement of the hammer piston simultaneously, yet independently. This reduces tool vibration caused by the reciprocating hammer piston substantially more effectively than the cushioning means of prior pneumatic impact tools.

More particularly, the energy-dissipating damping means includes a fixed damping chamber and a damping piston movable within the chamber to vary the chamber's volume. The energy-storing spring means includes a strike positioned to receive the periodic impacts from the rearwardly-moving hammer piston and a coil spring positioned between the strike and the damping piston of the damping means. Rearward movement of the hammer piston is resisted both by compression of the coil spring and by movement of the damping piston to reduce the volume of the damping chamber. In one aspect of the invention, the series arrangement of the damping means and spring means causes the two elements to resist rearward movement of the hammer piston by relative amounts that vary in accordance with hammer piston's impact speed. This results in improved damping and, thus, reduced vibration over a wide range of impact speeds.

In other aspects of the invention, the damping means further includes a surge chamber having a volume substantially larger than that of the damping chamber, along with means defining a passageway between the damping chamber and the surge chamber. Rearward movement of the damping piston, which reduces the damping chamber's volume, therefore directs fluid through the passageway from the damping chamber to the surge chamber. Pressure relief valve means can be included, to vent the fluid and surge chambers to atmosphere when the fluid pressure within them exceeds a predetermined level.

In another aspect of the invention, the impact tool is configured such that, following an initial impact of the rearwardly-moving hammer piston on the spring means strike, the combined masses of the hammer piston, tool housing cylinder, and spring means all move rearwardly together, to apply a force against the damping piston and thereby reduce the volume of the damping chamber. This effective increase in the rearwardly-moving mass is believed to improve the damping of tool vibrations.

Other aspects and advantages of the present invention will become apparent from the following description of the preferred embodiments, taken in conjunction with the accompanying drawings, which illustrate, by way of example, the principles of the invention.

DESCRIPTION OF THE PREFERRED EMBODIMENTS

Figure 1:
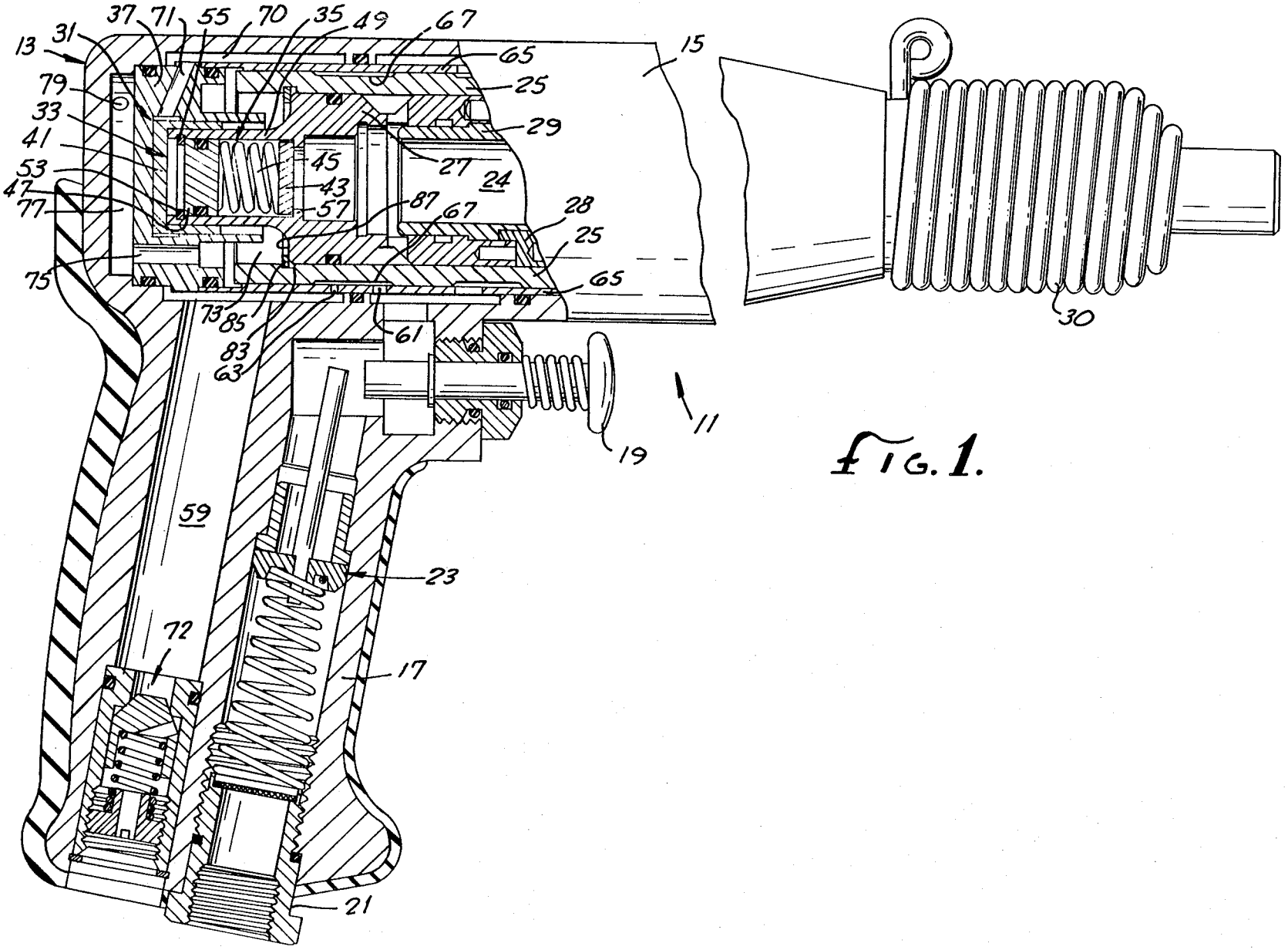
FIG. 1 is an elevational view of a pneumatic impact tool embodying the present invention, showing, in cutaway section, the tool's cushioning assembly in its unpressurized configuration.
Figure 4:
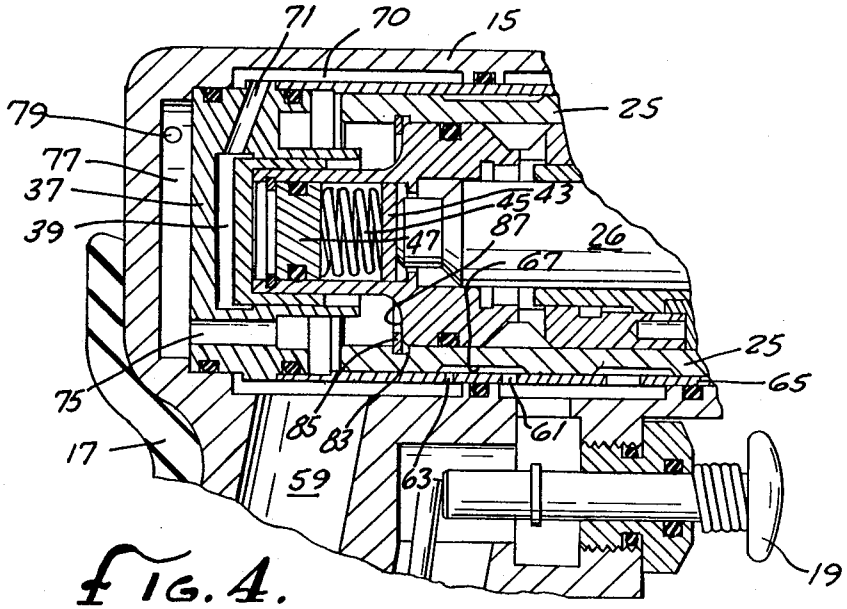
FIG. 4 is a partial sectional view of the cushioning assembly of FIGS. 1 and 3, shown after it has cushioned the impact of the recoiling hammer piston.
Figure 3:
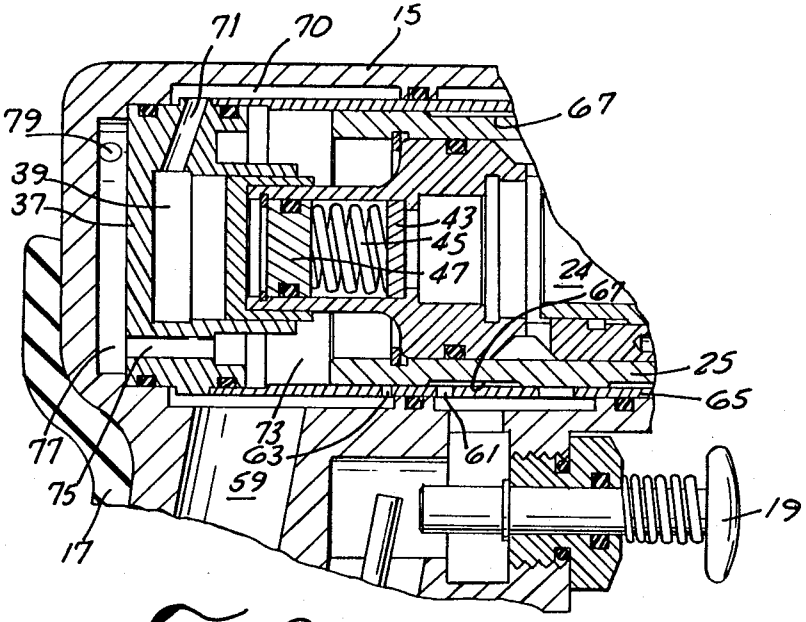
FIG. 3 is a partial sectional view of the cushioning assembly of FIG. 1, shown in its pressurized position ready to receive an impact from the rearwardly-moving, recoiling hammer piston.

With reference now to the drawings, and particularly to FIGS. 1, 3 and 4, there is shown a portable pneumatic impact tool 11 that produces vibrations that are substantially reduced from those produced by prior impact tools. The impact tool includes a tool housing 13 having a generally cylindrical barrel 15 and a pistol handle 17 projecting laterally from the barrel's rear end. A spring-biased trigger 19 is mounted on the handle, for selective use in operating the tool. The lower end of the pistol handle carries a fitting 21 suitable for connection to a source of pressurized air (not shown). As is conventional, actuation of the trigger opens a spring-biased valve 23, to deliver the pressurized air to the reaminder of the tool.

A hollow working space 24 is defined, in part, by a cylinder 25 located in the barrel 15, and a hammer piston 26 (FIG. 4) is reciprocably movable within the space. A conventional distribution valve assembly, portions of which are identified by the reference numerals 27, 28 and 29 in FIG. 1, directs pressurized air in such a way that the hammer piston repeatedly impacts on a tool attachment such as a rivet set (not shown) located at the barrel's forward end. A conventional wire-type tool retainer 30 secures the tool attachment in place.

Following each impact of the hammer piston 26 against the tool attachment, the distribution valve assembly directs pressurized air to move the piston to the barrel's rearward end. The piston's rearward movement or recoil occurs at substantially the same speed as its forward movement. Stopping the piston's rearward movement so that it can again move forward and impact on the tool attachment can cause undesired vibrations that are not only uncomfortable to the user, but also harmful to his hand and arm. To reduce the magnitude of these recoil vibrations, the tool further includes a cushioning assembly 31 at the barrel's rearward end, aligned with the hollow working space 24.

The cushioning assembly 31 includes a damping sub-assembly 33 and a spring sub-assembly 35. The two sub-assemblies are located in series with each other, at the rearward end of the barrel 15, to cooperate in efficiently cushioning the successive recoils of the hammer piston 26.

The damping sub-assembly 33 includes a cup 37 defining a cylindrical damping chamber 39 (FIGS. 3 and 4) and a damping plunger 41 sized to fit snugly within, and seal, the chamber. The cup is oriented with its open end facing the hollow working space 24, and the plunger is axially movable within the cup, to vary the damping chamber's volume.

The spring sub-assembly 35 is positioned forwardly of the damping sub-assembly 33 and it includes a disk-shaped bulkhead 43, a coil spring 45, and a disk-shaped strike 47. The spring is positioned between the base and strike, within a tubular extension 49 of the rear portion of the distribution valve assembly 27–29. The bulkhead, which faces rearwardly, is held in place by a lock ring 53 located within an annular recess 55 formed in the tubular extension 49, and the strike, which faces forwardly, is held in place by an inwardly-projecting annular flange 57. The forwardly-facing strike is positioned to receive an impact from the hammer piston 26, when the piston is moved rearwardly in the hollow working space 24.

In the embodiment of FIGS. 1, 3 and 4, actuation of the trigger 19 directs pressurized air into a surge tank 59 located within the pistol handle 17 and, from there, into the damping chamber 39 of the damping sub-assembly 33. More particularly, the pressurized air enters the surge tank via a control valve assembly that includes an inlet port 61 and an outlet port 63 located in a fixed cylindrical sleeve 65 and a shallow annular groove or waist 67 formed in the exterior surface of the cylinder 25 slidably received within the sleeve. The cylinder is normally biased by a coil spring (not shown) to the rearward position depicted in FIG. 1, such that pressurized air flows freely into the surge tank. Pressurized air flows, in turn, from the surge tank to the damping chamber 39 via an annulus 70 formed in the inwardly-facing surface of the barrel 15 and several passageways, one of which is identified by the reference numeral 71, aligned generally radially in the damping sub-assembly cup 37, between the annulus and the damping chamber.

In an alternative embodiment, the cylinder 25 is normally biased by a coil spring to the forward position depicted in FIG. 3. The damping chamber 39 and surge tank 59 are therefore pressurized only when the cylinder is manually retracted, against the bias of the coil spring. This is considered an important safety feature.

FIG. 3 depicts the damping sub-assembly 33 and the spring sub-assembly 35 when they are in condition to receive a rearward impact from the hammer piston 26. The damping chamber 39 is pressurized and depicted at its maximum volume, and the coil spring 45 is fully extended such that the bulkhead 43 and strike 47 bear against the lock ring 53 and annular flange 57, respectively.

FIG. 4 depicts the same structure as FIG. 3, but after the hammer piston 26 has impacted on the cushioning sub-assembly 31, causing a compression of the coil spring 45 and a reduction in volume of the damping chamber 39. After the hammer piston's initial impact with the strike 47, the piston's entire momentum is transfered to the combined mass of itself, the strike 47, the spring 45, the bulkhead 43, distribution valve assembly 27–29, and the cylinder 25. This combined mass moves rearwardly at a speed reduced from the hammer piston's impact speed, bearing against the damping plunger 41 of the damping sub-assembly 33.

Rearward movement of the damping plunger 41 compresses the air contained within the damping chamber 39, forcing it outwardly through the passageway 71 and annulus 70, into the surge tank 59. This dissipates a substantial portion of the energy of the rearwardly-moving mass. The air pressure in the surge tank is thereby increased slightly, leading to a release of air through a pressure relief valve 72, of conventional design, at the bottom end of the pistol handle 17. The pressure is thereby maintained at a substantially constant level. Eventually, the rearward movement is fully stopped and the damping sub-assembly 33 and spring sub-assembly 35 begin returning to their original states, as depicted in FIG. 3.

In one aspect of the invention, the damping sub-assembly 33 and the spring sub-assembly 35 are arranged in series with each other such that they operate simultaneously, yet independently of each other, in resisting rearward movement of the hammer piston 26. This facilitates an efficient cushioning of the hammer piston's rearward movement over a wide range of possible operating speeds. At high speeds, for example, the coil spring 45 of the spring sub-assembly compresses more rapidly than does the damping chamber 39 of the damping sub-assembly. Conversely, at low speeds, the coil spring compresses less rapidly than does the damping chamber.

FIGS. 3 and 4 show how a rearward movement of the cylinder 25 and distribution valve assembly not only reduces the volume of the damping chamber 39, but also reduces the volume of an annular cavity 73 encircling the tubular extension 49 of the distribution valve assembly. So that air is not thereby compressed within this cavity, which would inhibit a more-precisely controlled deceleration of the hammer piston 26 and cylinder, this cavity is vented through an axial passageway 75 in the damping sub-assembly cup 37 to a rear chamber 77 and, in turn, through a vent 79 to atmosphere. Subsequent forward movement of the cylinder and distribution valve assembly draws air back into the annular cavity 73 via the same vent 79, rear chamber 77, and axial passageway 75.

The inwardly-facing surface of the cylinder 25 includes an annular channel 83 for receiving a lock ring 85. This lock ring abuts against a rearwardly-facing shoulder 87 on the rear portion of the distribution valve assembly, to lock it in place.

Figure 2:
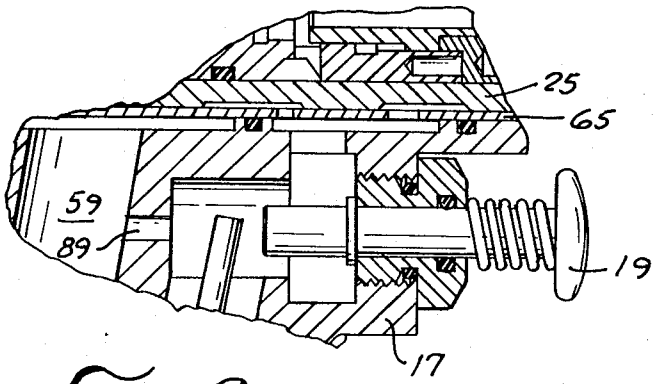
FIG. 2 is a partial sectional view of an alternative embodiment of the impact tool, this embodiment including a direct path for the pressurized air used by the cushioning assembly.

FIG. 2 depicts a modified embodiment of the invention, in which the inlet and outlet ports 61 and 63, respectively, of the valve sleeve 65 are eliminated and replaced by a passageway 89 leading directly from the region of the trigger valve 23 to the surge tank 59. In this embodiment, no means are included for preventing the trigger from pressurizing the surge tank and damping sub-assembly 33. In some cases, the embodiment of FIGS. 1, 3 and 4 is preferred over the embodiment of FIG. 2, because of the added safety it provides.

It should be appreciated from the foregoing description that the present invention provides a pneumatic impact tool exhibiting substantially reduced vibration during use. The successive recoils of a hammer piston are cushioned by both a damping sub-assembly and a spring sub-assembly that are arranged in series with each other such that they cooperate to cushion the impact over a wide range of operating speeds.

Although the invention has been described in detail with reference to the presently-preferred embodiments, those of ordinary skill in the art will appreciate that various modifications can be made without departing from the invention. Accordingly, the invention is limited only by the following claims.

We claim:

1. A low-vibration pneumatic impact tool comprising:
- a tool housing containing a hollow cylinder;
- a hammer piston positioned within the tool housing cylinder and reciprocably movable between a forward position and a rearward position; and
- cushioning means positioned between the tool housing and the rearward position of the hammer piston, for cushioning rearward movement of the hammer piston, the cushioning means including
  - energy-storing spring means, and
  - energy-dissipating damping means including means defining a damping chamber and a damping piston movable to vary the damping chamber's volume,
  - wherein the spring means and the damping means are arranged in series with each other to resist rearward movement of the hammer piston simultaneously yet independently, such that tool vibration caused by the reciprocating hammer piston is substantially reduced.

2. A low-vibration pneumatic impact tool as defined in claim 1, wherein:
- the damping chamber means is fixed relative to the tool housing;
- the spring means includes
  - a strike positioned to receive an impact from the rearwardly-moving hammer piston, and
  - a coil spring positioned between the strike and the damping piston; and
- rearward movement of the hammer piston is resisted by compression of the coil spring and by movement of the damping piston to reduce the volume of the damping chamber, the magnitudes of the respective resistances varying according to the rearwardly-moving hammer piston's speed.

3. A low-vibration pneumatic impact tool as defined in claim 2, wherein the damping means further includes:
- means defining a surge chamber having a volume substantially larger than the damping chamber's volume; and
- means defining a passageway between the damping chamber and the surge chamber, such that when the rearwardly-moving hammer piston causes the volume of the damping chamber to be reduced, fluid moves through the passageway, from the damping chamber to the surge chamber, thereby dissipating energy.

4. A low-vibration pneumatic impact tool as defined in claim 2, wherein the tool is configured such that, following an initial impact of the rearwardly-moving hammer piston on the strike of the spring means, the combined masses of the hammer piston, tool housing cylinder, and spring means move rearwardly together to apply a force against the damping piston of the damping means and thereby reduce the volume of the damping chamber.

5. A low-vibration pneumatic impact tool as defined in claim 1, and further including:
- a cylindrical valve encircling the tool housing cylinder, the valve being controllably movable between a forward, disable position and a rearward, enable position; and
- a manually-operable trigger secured to the tool housing, operation of the trigger directing a pressurized fluid through the cylindrical valve, when in its enable position, to reciprocate the hammer piston within the tool housing cylinder and further to pressurize the damping chamber.

6. A low-vibration pneumatic impact tool comprising:
- a tool housing including a barrel enclosing a hollow cylinder and a pistol handle;
- a hammer piston positioned within the hollow cylinder of the barrel and reciprocably movable by pressurized air between a forward, impact position and a rearward, recoil position;
- spring means including an energy-storing coil spring oriented with its axis aligned with the axis of the reciprocating hammer piston; and
- damping means including
  - means defining a damping chamber,
  - means defining a surge chamber having a volume substantially larger than that of the damping chamber,
  - means defining a fluid passageway between the damping chamber and the surge chamber, and
  - a damping plunger positioned within the damping chamber and movable along the axis of the reciprocating hammer piston, to vary the damping chamber's volume,
  - wherein the spring means and the damping means are arranged in series with each other to resist rearward movement of the hammer piston simultaneously yet independently, such that tool vibration caused by the reciprocating hammer piston is substantially reduced.

7. A low-vibration pneumatic impact tool as defined in claim 6, wherein:
- the damping chamber means is fixed relative to the tool housing;
- the spring means further includes a strike positioned to receive an impact from the rearwardly-moving hammer piston;

the coil spring is positioned between the strike and the damping plunger; and rearward movement of the hammer piston is resisted by compression of the coil spring and by movement of the damping plunger to reduce the volume of the damping chamber and thereby force fluid from the damping chamber through the passageway to the surge chamber.

8. A low-vibration pneumatic impact tool as defined in claim 7, wherein the tool is configured such that, following an initial impact of the rearwardly-moving hammer piston on the strike of the spring means, the combined masses of the hammer piston, spring means, and barrel cylinder move rearwardly together to apply a force against the damping plunger of the damping means.

9. A low-vibration pneumatic impact tool as defined in claim 6, wherein the spring means and the damping means are configured such that the magnitudes of the respective resistances of the spring means and damping means to the rearwardly-moving hammer piston varies according to the hammer piston's impact speed.

10. A low-vibration pneumatic impact tool as defined in claim 6, wherein the damping means further includes pressure relief valve means for venting the damping chamber and surge chamber to atmosphere when the fluid pressure within the chambers exceeds a predetermined level.

11. A low-vibration pneumatic impact tool as defined in claim 6, and further including:

a cylindrical valve encircling the barrel cylinder, the valve being movable between a forward, disable position and a rearward, enable position; and a manually-operable trigger secured to the tool handle, operation of the trigger directing pressurized air through the cylinder valve, when in its enable position, to reciprocate the hammer piston within the barrel cylinder and further to pressurize the surge chamber and damping chamber.

* * * * *